United States Patent [19]

Julian

[11] 4,144,812

[45] Mar. 20, 1979

[54] PRINTING SLEEVES

[75] Inventor: Anthony P. Julian, Hambrook, England

[73] Assignee: Strachan & Henshaw Limited, Speedwell, England

[21] Appl. No.: 802,722

[22] Filed: Jun. 2, 1977

Related U.S. Application Data

[63] Continuation-in-part of Ser. No. 755,157, Dec. 30, 1976.

[30] Foreign Application Priority Data

| | | | |
|---|---|---|---|
| Jan. 8, 1976 | [GB] | United Kingdom | 609/76 |
| Jan. 8, 1975 | [GB] | United Kingdom | 700/76 |
| Apr. 4, 1977 | [GB] | United Kingdom | 14060/77 |

[51] Int. Cl.[2] ..... B41F 27/00

[52] U.S. Cl. ..... 101/382 R; 101/368; 101/375; 29/132; 29/446

[58] Field of Search ..... 101/375, 401.1, 368, 101/327, 329; 29/122, 129.5, 132, 427, 446

[56] References Cited

U.S. PATENT DOCUMENTS

| | | | |
|---|---|---|---|
| 1,329,762 | 2/1920 | Guy | 29/446 |
| 2,840,399 | 6/1958 | Harless et al. | 29/446 |
| 2,926,940 | 3/1960 | Maass | 29/446 |
| 2,949,852 | 8/1960 | Schaefer | 101/375 |
| 2,992,479 | 7/1961 | Musser et al. | 29/446 |
| 3,146,709 | 9/1964 | Bass et al. | 101/375 |
| 3,402,449 | 9/1968 | Schröder | 101/375 |
| 3,639,959 | 2/1972 | Bagley et al. | 29/132 |
| 3,721,188 | 3/1973 | Jacobsen et al. | 101/375 |
| 3,859,701 | 1/1975 | Huber | 101/401.1 |
| 4,030,415 | 6/1977 | Fellows | 101/282 R |

FOREIGN PATENT DOCUMENTS

| | | | |
|---|---|---|---|
| 599251 | 3/1948 | United Kingdom | 29/427 |
| 599304 | 3/1948 | United Kingdom | 29/427 |

*Primary Examiner*—William Pieprz
*Attorney, Agent, or Firm*—Omri M. Behr

[57] ABSTRACT

For fitting a printing sleeve in a printing roll the outer surface of the roll core and preferably the inner surface of the sleeve are made with one end of a lesser diameter than the other; the sleeve is slightly undersize diametrically. Remote from the ends of the core are orifices whereby gas under pressure may be blown radially outwardly from the core. The difference in diameter allows the sleeve to be passed freely along the core until it jams up against an increased diameter portion of the outer surface of the roll, at which time it covers the orifices. Gas is then blown from the orifices to expand the sleeve which can then be moved into its working position on the core. A sleeve specially suitable for this treatment is made by laying-up a seamless GRP layer on a former which is undersize for the designed core and either curing a rubber layer in situ onto the layer, or adhesively securing a flexible plate to a true cylindrical outer surface of the GRP layer.

A transition between the regions of different diameter of the outer surface of the roll core may be made by a frusto-conical taper (preferably of the order of 5 parts in 10,000 to 20,000) or by at least one step (preferably slightly greater than the designed undersize of the sleeve, say 0.008 and 0.006 inches respectively).

8 Claims, 7 Drawing Figures

Figure 1:
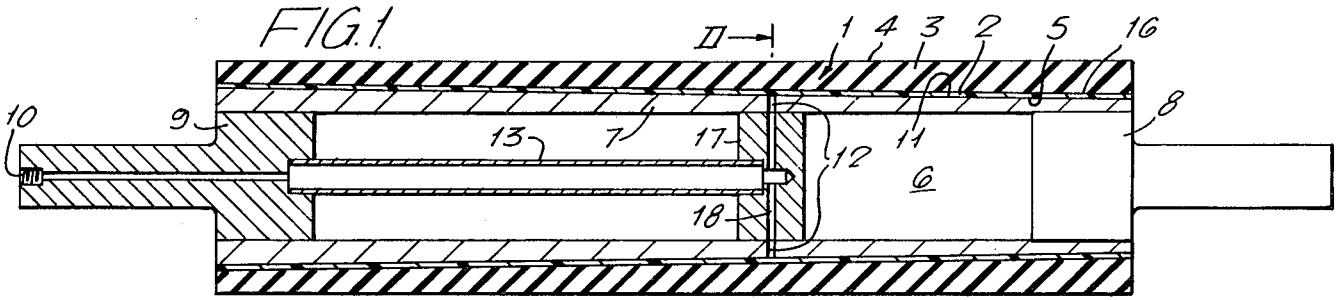

16
8
5
2
3
4
1
14
G
12
II
17
18
7
13
9
10

I
4
3
2
5
11
12
18
17
7

1
5
d4
G
A
12
17
12
18
d3
13
11
9
d2
14
11
d1
10

PRINTING SLEEVES

CROSS REFERENCE

This is a continuation-in-part of my U.S. patent application Ser. No. 755,157 filed Dec. 30, 1976.

FIELD OF THE INVENTION

This invention relates to methods and means for manufacturing and mounting printing sleeves.

BACKGROUND OF THE INVENTION

Printing sleeves which are mountable on and demountable from printing rolls are known in several forms of printing particularly flexography. The manner in which they may be mounted and demounted on the roll cores has caused problems and their manufacture in a manner which is compatible with mounting and demounting has also created considerable difficulty.

Examples of some ways which have been explored for allowing mounting and demounting of various types of sleeves or rolls, are seen in U.S. Pat. Nos. 2,117,722, 2,450,727, 2,501,630 and 3,035,331. The last of these is of some interest in the present context since it shows the contraction of an outer surface of a printing roll core by the application of vacuum within it while an inextensible printing sleeve is fitted over it. When the vacuum is released, the core surface expands into the sleeve. Though this is conceptually elegant it does imply necessarily a compressible printing roll core, something which may be incompatible with good working results, and even if this problem were overcome the design of such a core from the point of view of allowing a sufficient vacuum passage volume would be a matter of great difficulty.

It is probably for these reasons that the application of positive gas pressure to expand the sleeve during the time that it is being fitted on or taken off a printing roll core was proposed in U.S. Pat. No. 3,146,709 which was published in 1964. There, the inventors had the general idea that air could be blown from the roll core outwardly so as to tend to expand the printing sleeve as it was fitted on it. However difficulty is encountered in the initial fitting of the sleeve since no expansion will take place until sufficient of the apertures through which air issues from the centre of the core have already been covered. Also, there will be a loss of efficiency in the process as a whole because of the loss of air through uncovered holes.

This same U.S. Pat. No. 3,146,709 discloses a way of making a printing sleeve which consists of prepreparing a cylindrical body of a sheet of polyester plastics, taping it into a cylindrical form by a helical winding of an adhesive tape and then helically winding on the adhesive tape a double-sided adhesive tape known in the trade as "sticky-back". Then, a layer of rubber or rubber-like material is lapped around the cylindrical body and held by adhesion on the sticky-back. Indeed the rubber layer is referred to in that patent as a rubber plate. It will be realised that when such a compound sleeve is expanded by the effect of gas underneath it there is a tendency for leakage through adjacent edges of the sheet which can cause a blister or bubble to form under the attached plates.

SUMMARY OF THE INVENTION

To overcome the problem involved in the initial fitting of these prior art sleeves while at the same time avoiding the special and complex design problems encountered if the core is to be compressed for fitting the sleeve, there is provided a method of fitting a printing sleeve to a printing roll which consists of preparing a roll core with an outer surface of which one longitudinal end has a diameter greater than that of the other longitudinal end and a printing sleeve with an inner surface designed to be an interference fit with the outer surface of the core at a designed working position, moving the sleeve onto the core from the end of the core of lesser diameter with an end of the sleeve of greater diameter leading, until the sleeve and core touch around the inner circumference of the sleeve and the sleeve has covered all gas outlets in the core surface, applying gas under pressure inside the sleeve from the said gas outlets to expand the sleeve radially and moving the sleeve while so expanded to its designed working position on the core.

The inner surface of the sleeve is preferably of a taper configuration corresponding to that of the outer surface of the roll, but the outer surface may have a stepped transition between its ends of different diameter.

The axial length of this sleeve is the same as the axial length of the core bearing the sleeve, this length is designated as the working length.

The method also comprises forming the printing sleeve by coating a shell of fibre-reinforced polyester or epoxy resin with an uncured rubber and curing the rubber in situ to provide a printing surface of the sleeve.

Also in the invention there is provided a printing sleeve which consists of a fibre reinforced polyester or epoxy resin shell, of which the radially inner surface has a different diameter at one end than at its other, on an outer and cylindrical surface of which sleeve is a printing surface. The sleeve may include a rubber coating, cured in situ on the shell. To prepare the coating for printing, known finishing and engraving processes may be used upon its rubber surface when, the rubber is already vulcanised onto the shell. When the inner surface of the shell is tapered the outer surface of the shell may be cylindrical so that the shell is of varying thickness, or the shell may be of uniform thickness so that the rubber layer, when its outer surface is trued, is of varying thickness. A flexible printing plate or plates may be adhesively secured to a cylindrical outer surface of the coating or of the shell, to provide the printing surface.

The invention also provides a detachable sleeve printing roll consisting of a core having an outer surface which has one longitudinal end of a diameter greater than that of its other longitudinal end and has apertures serving as compressed gas outlets positioned remote from the ends of the core and a sleeve forming under stress an interference fit with the outer surface of the core in its working position, at least one end of the sleeve having in its unstressed condition an internal diameter between the maximum external diameter of the core and the external diameter of that portion of the core with gas outlets in its surface.

The change in diameter from one end to the other is progressive (i.e. only increases or only decreases according to the direction one is moving along the roll) but may be in the form of a taper, or of a stepped transition. If a conical taper is used, it is slight and a preferred taper is in the range of 5 parts in 10,000 to 5 parts in 20,000. The latter is most preferred. In such a taper, the diameter of the roll core changes by 0.00025 units per unit of axial length of the roll. If as is preferred the whole of the outer surface of the roll core has a conicity it can be seen than a properly prepared printing sleeve of which the shell has a corresponding internal conicity can be freely fitted by hand from one end of the roll core until it gets to a position at which the surfaces of the sleeve and roll touch. This is a certain distance from its designed working position. Since the gas outlets are grouped away from the axial ends of the roll core, in this position it will cover all such outlets and then gas pressure may be applied to within the sleeve from within the core to expand the sleeve and enable it to be moved further along the roll to its designed working position upon this core. To take a specific example, if the core is essentially 12 cm in diameter, the sleeve is undersize by 0.012 cm in its working position, and the taper of the core is 5 parts in 20,000, the position at which the sleeve and core touch will be approximately 48 cm from the working position. If the sleeve has been made as indicated above, the rubber of the sleeve has been bonded to the shell and has no seam so it will not be lifted or distorted by the application of this pressure, and there will be no gap through which radial leakage can occur.

The stepped embodiment has the main advantage that the stepped formation of the outer surface of the core is easier to manufacture than a frusto-conical surface.

In that embodiment a roll core of a printing roll has a radially outer surface having at least one stepped change in diameter between its ends and a gas outlet in the radial outer surface of lesser diameter and spaced from each end of the core. Gas outlets are preferably adjacent the stepped change in diameter.

In this aspect, the present invention also provides a printing sleeve capable of being fitted under internal gas pressure to a roll core which sleeve has an inner surface with at least one stepped portion and is capable of being expanded by gas pressure inside the sleeve so as to pass onto a corresponding stepped printing roll core with which it is a designed interference fit.

The preferred relationship between the core and the roll is that the height of the step between the regions of different diameter of the core is greater than the designed interference between the portion of the sleeve of greater diameter and the portion of the core of greater diameter. The result of this is that the portion of the sleeve of greater diameter may be passed freely over the portion of core of lesser diameter but will then positively abut against the axial face of the stepped discontinuity and diameter whereby to define a gas-containing enclosure between the sleeve and the core. Preferably also the axial length of the portion of the sleeve of greater diameter will correspond with the axial length of the portion of core of lesser diameter so that when the leading end of the sleeve abuts against the step, the complementary step within the sleeve will abut against the end of the core which is of lesser diameter, additionally to define that gas-containing enclosure.

DESCRIPTION OF THE DRAWINGS AND OF PREFERRED EMBODIMENTS

Figure 2:
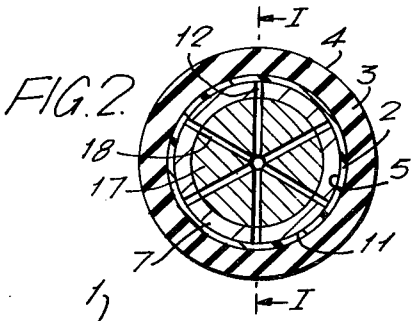
Figure 3:
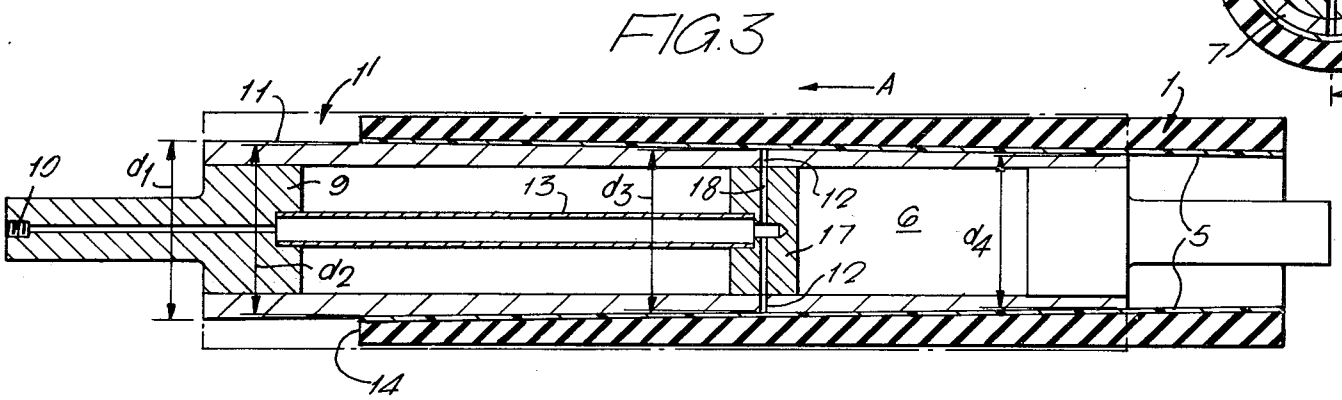
Figure 4:
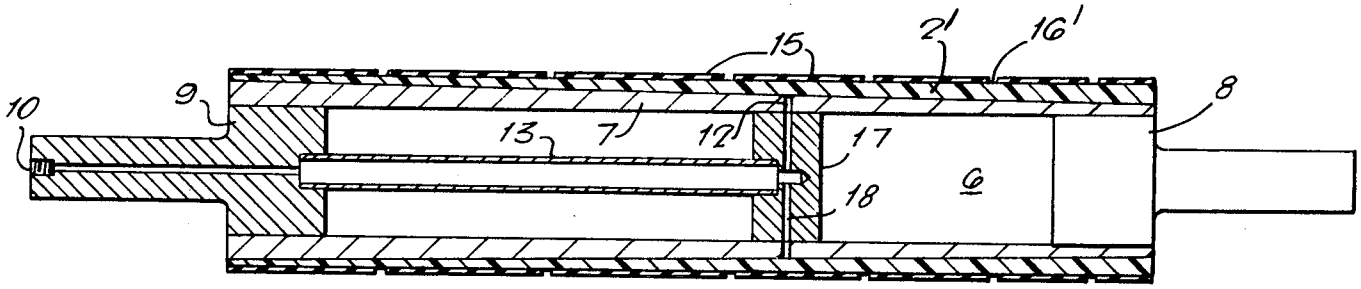
Figure 5:
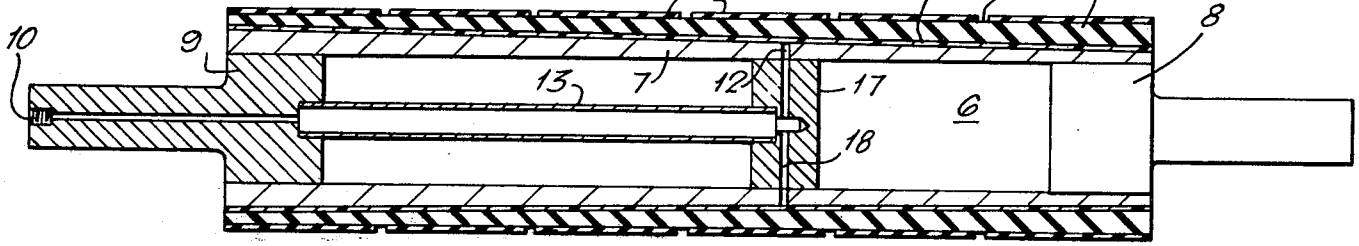
Figure 6:
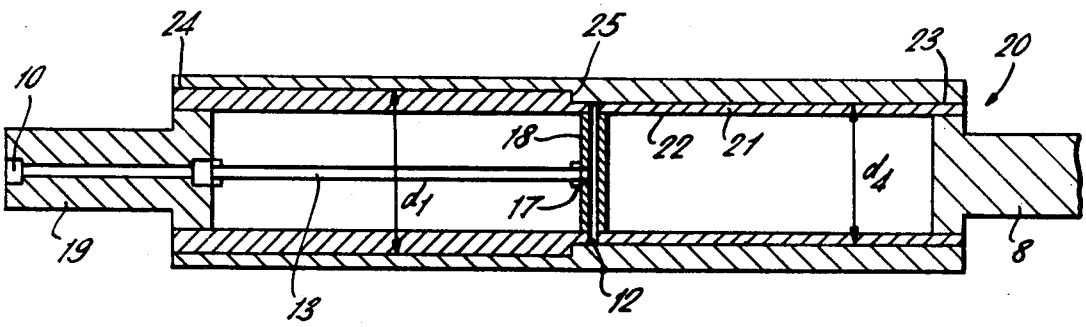
Figure 7:
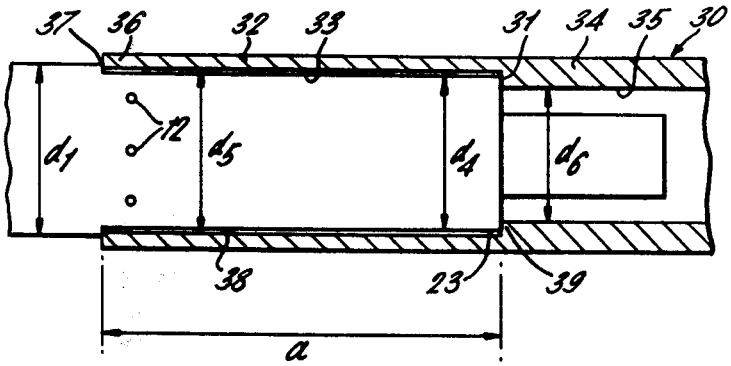

Particular embodiments of the invention and particular methods according to the invention will now be described with reference to the accompanying drawings, wherein:

FIG. 1 is a diametrical section through a first embodiment of sleeve and core on the line I—I, FIG. 2, FIG. 2 is a section on the line II—II, FIG. 1, FIG. 3 is a section as FIG. 1, but showing the sleeve in an initial position, FIGS. 4 and 5 are sections like that of FIG. 1 but showing, respectively, alternative forms of sleeve, and FIGS. 6 and 7 are a section and a partial elevation/-partial section respectively showing an assembled second embodiment and a stage in its assembly, analogous to the stages seen in FIGS. 1 and 3.

Referring first to FIG. 1, a printing sleeve 1 consists of a radially inner shell 2 surrounded by a rubber layer 3, on an outer surface 4 of which relief may be formed for printing purposes. A radially inner surface 5 of the shell has a progressive change in diameter as between its ends, in this case having a slight frusto-conical taper (much exaggerated in the drawing). A taper of the order of 0.00025 units (e.g. inch or cm) of change in diameter per 1 unit of axial length is suitable. The shell 2 is of constant radial thickness and its radially outer surface 16 has the same taper as the inner surface 5; in modifications the outer surface 16 could be cylindrical or could be tapered but of a taper different from that of the inner surface 5. The printing surface 4 is, of course, a true cylinder.

FIG. 1 shows the printing sleeve 1 in its working position (i.e. axially central along) a printing roll core 6. The core 6 is hollow, having an incompressible hollow metal tube supported at each end by axled roll ends 8,9. One core end 9 has a gas line connector 10 through which gas under pressure may be introduced to ducting 13 inside the volume enclosed by the tube 7 and ends 8,9. Gas can only escape from this radially through radial ports 18 in a block 17 which lead to outlets 12 circumferentially spaced apart around the core in a plane remote from both axial ends of the core, and preferably in the region of the middle of the axial length of the core 6. The region where the outlets 12 are has an outer diameter of $d_3$. The radially outer surface 11 of the tube 7 is given a progressive change in diameter between its ends complementary to that of the surface 5 of the shell 2 of the printing sleeve 1 so that one end has a diameter $d_1$ and the other end has a diameter $d_4$; $d_1$ is greater than $d_3$ and $d_3$ is greater than $d_4$, and in this case there is a continuous taper between them.

To form the printing sleeve, a fibre reinforced resin such as a glass reinforced polyester or glass reinforced epoxy resin is laid-up on a former having a desired taper, to a depth of approx. 1/16" (approx. 1.5 mm). The layer is of uniform thickness so that its outer surface has the same taper as its inner surface. It is allowed to harden to form the seamless shell 2 and a coating of uncured rubber (the term including, of course, synthetic rubbers and other suitable elastomers) is applied to the outer surface. The rubber is cured in situ and thereby is hardened as a complete, gapless, seamless, tube 3 simply bonded to the shell 2. When as in the preferred embodiments the taper is as low as 5 parts in 20,000, a uniform thickness shell may all the more readily be used since the difference in radial thickness in the rubber layer along the length of the core (the outer surface of the rubber layer being brought to a true cylinder, of course) is negligible in its effect. The outer surface of the rubber is then ground true and engraved or otherwise prepared for printing. Alternatively as indicated in FIG. 5, the outer surface 4' of the rubber layer may be ground to a true cylinder after curing, and used as a base to which a flexible printing sheet or sheets such as stereos 15 are secured by adhesion by the use, for example, of "sticky-back".

Although the preparation of a constant thickness shell 2 is preferred since its laying-up is a simple matter, it is possible to lay-up a shell of varying thickness, to yield either a shell with a taper at its outer surface 16 different from that of the inner surface, or one with a true cylindrical outer surface.

In FIG. 4 the latter is shown. A shell 2' is laid-up as before, but so as to give a cylindrical outer surface 16'. After curing of the GRP, this is ground true and flexible plate (s) such as stereos 15 may be adhered direct to the surface 16' by means of "sticky-back".

It is apparent that, at least as far as the steps of making the sleeve itself are concerned they are applicable also to the making of seamless sleeves with a cylindrical internal surface.

The following discussion of fitting procedures will for brevity be given using the reference numbers seen in FIGS. 1 and 3 but it is of completely equal applicability to the embodiments of sleeve seen in FIGS. 4 and 5.

The former on which the shell is laid-up is diametrically undersize relative to the printing roll 6 on which the sleeve is to be fitted, so that the sleeve when formed with have the greatest diameter greater than the least diameter of the core but less than its greatest diameter and will be able to be passed freely along the core in the direction of the arrow A, FIG. 3, only for part of the length of the core. A major part, say $\frac{3}{4}$, is preferred. Then, the inner circumference of at least the leading end 14, of which the unexpanded inner diameter is $d_2$ ($d_1 > d_2 > d_3$) touches all round on the core and wedges against it. This condition is seen in full lines in FIG. 3. To bring the sleeve 1 to the working position it is expanded by means of gas passed through outlets 12 (all of which are at that stage covered by the sleeve) and pressed further in the direction of the arrow A to its working position 1' in FIG. 3, or as it is seen in full lines in FIG. 1. Because of the undersize of the sleeve 1 and the only very slight taper given to the surfaces 5 and 11, when the gas pressure is vented to the atmosphere the sleeve will hold itself firmly in stressed condition on the core in its working position, ready for use.

Because of the taper of the surfaces and the positioning of the gas outlets, gas pressure need not be applied during the initial positioning of the sleeve 1 on the core 6 but only after all outlets 12 have been covered by the sleeve 1. Although it is preferred that the surfaces 5, 11 shall be continuously and constantly tapered, at least some of the advantages of the invention will be obtained when only a portion of the surface 11 of the core is tapered, preferably a major portion at the end which is last covered by the sleeve during the fitting process.

The second embodiment will now be described with reference to FIGS. 6 and 7.

These Figures show a roll core 20 including a hollow cylinder 21 having an internal surface 22 which is a cylinder of constant diameter and an external surface of which one end portion 23 has a lesser diameter than the other longitudinal end portion 24. The smaller diameter portion 23 has a diameter $d_4$ and the larger diameter portion 24 has a diameter $d_1$ and they meet at a stepped discontinuity 25 having a planar axial face, the radial height of the step being $\frac{1}{2}(d_1-d_4)$. As in the previous embodiment, ends of the roll core are defined by axle roll ends 8,9, the end 9 having a gas line connector 10 through which gas under pressure may be introduced to ducting 13 within the volume enclosed by the cylinder 21 and ends 8,9.

Ducting 13 coducts gas to a block 17 containing radial ports 18, which lead to outlets 12 spaced around the circumference of the core in the portion of lesser diameter $d_4$ and adjacent to the step 25.

A seamless printing sleeve 30 is formed by any of the methods previously disclosed in connection with the said U.K. patent applications but so as to have not a continuous taper on its inner surface as was there disclosed, but stepped discontinuity 31 complementary to step 25 and at a position such that when this is facially abutted against the step 25 the working position of the sleeve upon the core will be defined. The position of the steps 25,31 is also such that the axial length a (FIG. 2) of the portion 23 of lesser diameter of the core is equal to the axial length of an end portion 32 of the sleeve 30 which has an inner surface 33 of greater diameter.

The other end portion 34 of the sleeve 30 has an internal surface 35. The diameter of the surface 33 will be designated $d_5$ and that of surface 35 as $d_6$.

The sleeve is designed to have a designed interference fit i.e. to be a predetermined amount undersize in comparison to the core, when the sleeve is in unstressed condition. It is the relaxation of the sleeve towards that unstressed condition, after it has been expanded and placed in its working position, which retains it in its working position on the core. It is preferred to make the difference between $d_1$ and $d_4$ slightly greater than the designed undersize of sleeve on the core or in other words that $d_1$ shall be very slightly greater than $d_5$. This means that when as seen in FIG. 2 the leading end 36 of the sleeve has been passed over the portion 23 of the core it will abut against the planar annular face of the step 25 over a thin area of contact 37 whereby to define one end of a gas containing volume 38 between the sleeve and the core. Similarly the step transition 31 in the inner surface of the sleeve will abut against the end face of the core at a very narrow line interface 39 to define the other end of that gas-containing volume. Then, gas is introduced under pressure through the outlets 12 into that volume to expand the sleeve which can then be moved into position over the core, gas escaping from the chamber 38 through the narrow leak path defined between the (expanded) surface 35 and the surface of core portion 23 on the one hand and the (expanded) surface 33 and the surface of core portion 24 on the other hand.

As mentioned this embodiment is easier to manufacture than the previously described one.

The extent of the height of the steps 31,25 has been much exaggerated in the drawings, for the sake of clarity and it may be, as has been described, very slightly greater than the designed undersize of the sleeve on the core. Typically such a designed diametrical undersize would be 0.006 inch, with the difference in diameter $d_1-d_4$ then being 0.008 inch.

I claim:

1. A printing roll comprising (i) an incompressible core having two axial ends at the end portions of the core an outer surface of the core having a working length extending between and up to each of the said ends and adapted to receive and support an expansible printing sleeve the outer surface of the core having end portions of which the respective diameters are different whereby the working length of the outer surface has a minimum diameter and a maximum diameter, the transition between said portions of minimum and maximum diameter comprising a stepped transition gas outlets in the outer surface, said outlets being located in the working length of the outer surface on the side of the circumference of interference havine the lesser diameter between the sleeve and the core wherein the said circumference of interference is the circumferential line on the core located at that location on the core beyond which one end of the sleeve, when slid on the core from the end of minimum diameter thereof cannot be moved towards the end of maximum diameter of the core without expansion of the sleeve, means for passing gas under pressure to said outlets to pass radially outwardly from them and the said sleeve being (ii) a seamless sleeve, the sleeve being diametrically undersize for the core when in unstressed condition, the sleeve having two axial ends, at least the said one of said ends having in an unstressed condition an internal diameter greater than the said minimum diameter and less than the said maximum diameter of the outersurface of the core.

2. A printing roll as claimed in claim 1 wherein said sleeve has a radially inner seamless sleeve layer and a radially outer seamless sleeve layer, the radially inner sleeve layer comprising reinforced plastics material the radially outer sleeve layer comprising an elastomer material bonded to the radially inner sleeve layer.

3. A printing roll as claimed in claim 2 further comprising a flexible printing plate adhesively secured to the radially outer surface of the sleeve.

4. A printing roll as claimed in claim 1 wherein the diametrical height of the stepped transition is greater than the undersize of the sleeve in unstressed condition.

5. In a printing roll comprising a roll core having a working length and an expansible sleeve surrounding the core removably mounted on it in a working position by an interference fit with its outer surface and having means in the core for passing gas under elevated pressure outwardly from its outer surface to expand the sleeve the improvement comprising one axial end of the outer surface of the working length of the core being of a diameter less than the unexpanded inside diameter of at least one end of the sleeve and the other axial end of the outer surface of the working length of the core being of a diameter greater than the unexpanded inside diameter of the said one end of the sleeve, the transition between said portions of lesser diameter and of greater diameter comprising a stepped transition, said gas passing means in the outer surface being located towards the narrower end of the roll from the circumference of interference between the sleeve and the core, wherein the said circumference of interference is the circumferential line on the core located at that location on the core beyond which the one end of the sleeve, when slid on the core from the end of minimum diameter thereof cannot be moved towards the end of maximum diameter of the core without expansion of the sleeve.

6. The roll as claimed in claim 5 wherein said gas passing means are located rearwardly of the stepped transition towards the narrower end of the roll.

7. The improvement as claimed in claim 5 wherein the diametrical height of the step is such that the face of the step abuts the said one end of the unextended sleeve.

8. The improvement as claimed in claim 7 wherein the diametrical undersize of the sleeve is about 0.006 inch and the diametrical height of the step is about 0.008 inch.

* * * * *